US012060708B2

(12) United States Patent
Underkofler

(10) Patent No.: US 12,060,708 B2
(45) Date of Patent: Aug. 13, 2024

(54) LIGHT GAUGE MAIN TEE SPLICE

(71) Applicant: USG Interiors, LLC, Chicago, IL (US)

(72) Inventor: Abraham M. Underkofler, Salem, WI (US)

(73) Assignee: USG INTERIORS, LLC, Chicago, IL (US)

( * ) Notice: Subject to any disclaimer, the term of this patent is extended or adjusted under 35 U.S.C. 154(b) by 109 days.

(21) Appl. No.: 17/816,462

(22) Filed: Aug. 1, 2022

(65) Prior Publication Data

US 2024/0035276 A1 Feb. 1, 2024

(51) Int. Cl.
*E04B 9/10* (2006.01)
*E04B 9/06* (2006.01)

(52) U.S. Cl.
CPC ..... *E04B 9/10* (2013.01); *E04B 9/068* (2013.01)

(58) Field of Classification Search
CPC ..... E04B 9/10; E04B 9/068
See application file for complete search history.

(56) References Cited

U.S. PATENT DOCUMENTS

| | | | | |
|---|---|---|---|---|
| 4,989,387 | A * | 2/1991 | Vukmanic | E04B 9/122 52/667 |
| 5,271,202 | A * | 12/1993 | Vukmanic | E04B 9/122 52/506.07 |
| 5,761,868 | A | 6/1998 | LaLonde | |
| 6,729,100 | B2 | 5/2004 | Koski et al. | |
| 10,947,725 | B2 * | 3/2021 | Lin | E04B 9/006 |
| 11,053,682 | B1 | 7/2021 | Zhang | |
| 11,220,819 | B2 | 1/2022 | Zhang | |
| 2003/0200719 | A1 * | 10/2003 | Koski | E04B 9/068 52/843 |
| 2020/0149275 | A1 * | 5/2020 | Lin | E04B 9/006 |
| 2020/0378116 | A1 | 12/2020 | Jankovec | |
| 2021/0285212 | A1 * | 9/2021 | Zhang | E04B 9/10 |

OTHER PUBLICATIONS

International Search Report and Written Opinion of PCT/US2023/028846, filed Jul. 27, 2023, dated Dec. 4, 2023.

* cited by examiner

*Primary Examiner* — Rodney Mintz
(74) *Attorney, Agent, or Firm* — Pearne & Gordon LLP

(57) ABSTRACT

An integral main tee connector arranged to couple with an identical connector stamped from metal strip material aligned strip-wise with material making a web of the main tee the connector when connected to another identical connector exhibiting at least five locking zones distributed over an expanse of each connector.

5 Claims, 2 Drawing Sheets

LIGHT GAUGE MAIN TEE SPLICE

BACKGROUND OF THE INVENTION

The invention relates to improvements in suspended ceiling grid components and, in particular to integral end connectors for main runners or tees.

PRIOR ART

Main runners of suspended ceiling grid often have integral end connectors. Examples of such connectors are shown in U.S. Pat. Nos. 6,729,100; 11,053,682; and 11,220,819. The tensile strength of a connection formed by this type of connector may be limited by connector design, gauge and strength of runner material. It is desirable that integral connectors have sufficient coupling strength that they do not require a metal gauge heavier than that otherwise required for proper performance of the associated runner.

SUMMARY OF THE INVENTION

The invention provides an integral main tee connector that is suitable for use with runners of relatively light gauge metal, such as hot dipped galvanized steel. The connector is arranged with five locking zones with each zone preferably having at least two engagement points. The disclosed arrangement thereby distributes coupling tensile forces throughout a joint. The load is reduced at any particular location to a fraction of the total tensile load, thus reducing the risk of a local failure followed by progressive total failure. Preferably, each catch or locking element is lanced from the metal connector body giving the catch or locking element high strength and stability. Associated with the lanced catch locking elements are stiffening beads that minimize connector distortion underload, thereby improving the performance of the locking elements. A spring-like tab of each connector serves to maintain engagement of associated locking elements of an opposed connector.

DESCRIPTION OF THE PREFERRED EMBODIMENTS

Figure 1:
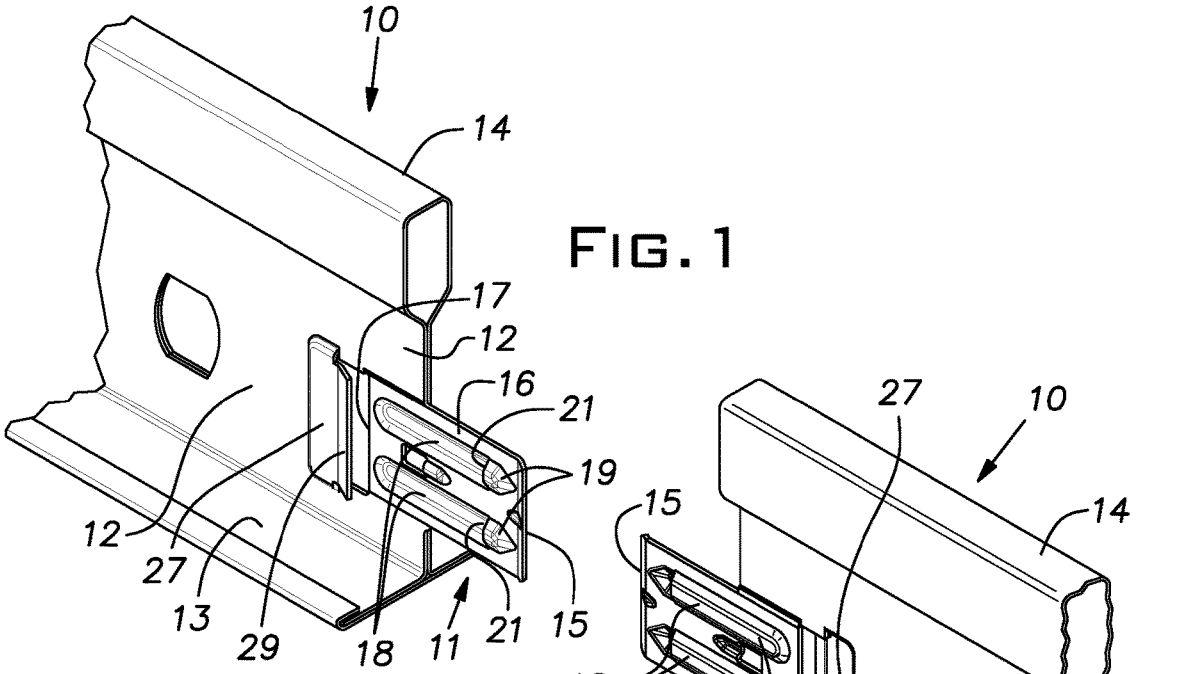
FIG. 1 is a perspective view of the ends of main runners and inventive integral connectors.
Figure 2:
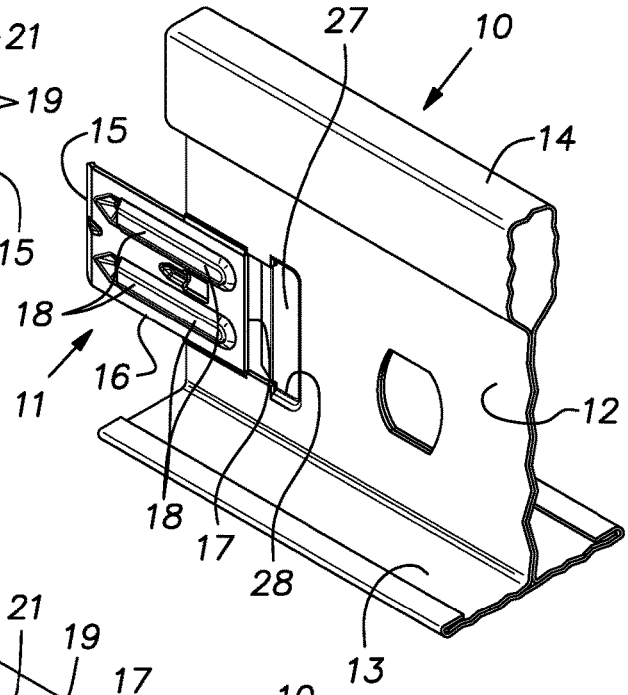
FIG. 2 is a perspective view of main runner ends connected by the inventive connectors.
Figure 2:
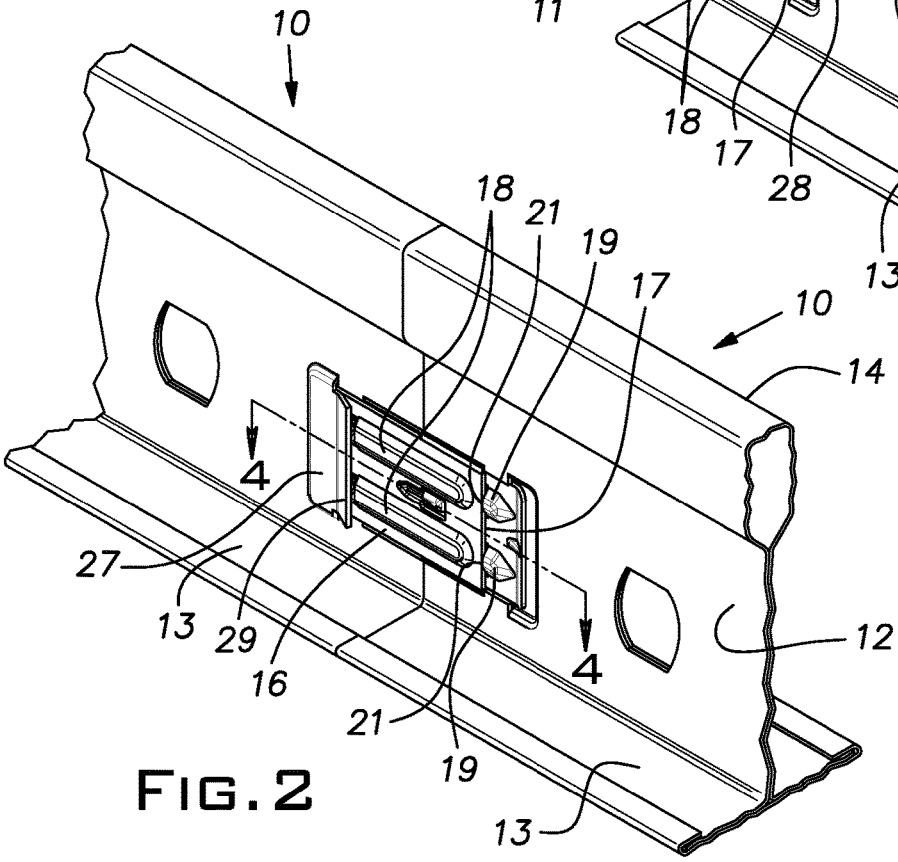
Figure 3:
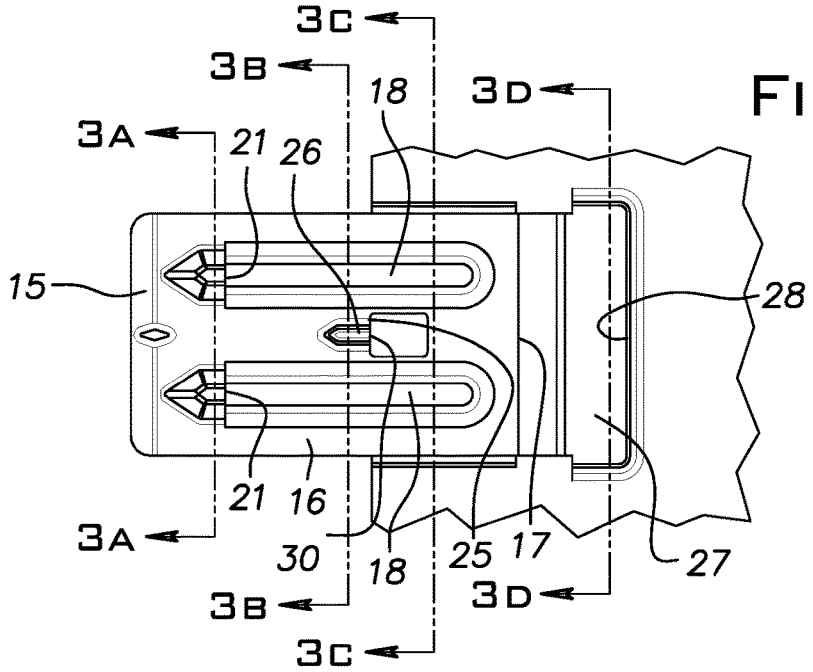
FIG. 3 is a side view of the connector.
Figure 3A:
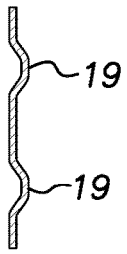
FIG. 3A is a cross-sectional view of the connector taken in the plane A-A of FIG. 3.
Figure 3B:
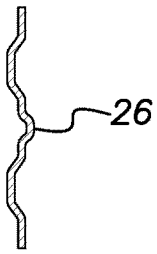
FIG. 3B is a cross-sectional view of the connector taken in the plane B-B of FIG. 3.
Figure 3C:
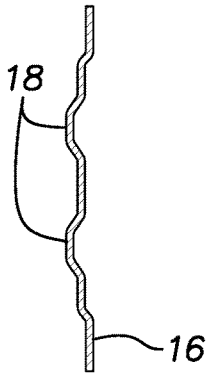
FIG. 3C is a cross-sectional view of the connector taken in the plane C-C of FIG. 3.
Figure 3D:
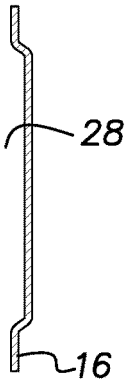
FIG. 3D is a cross-sectional view of the connector taken in the plane D-D of FIG. 3.

FIGS. 1 and 2 show end portions of main tees or runners 10, the full length of which may be nominally 12 feet long. At each end, a runner 10 has an integral connector 11 made with stamping dies. A runner preferably made with light gauge hot dipped galvanized steel, having a thickness as low as, for example, 0.010 inch, has an inverted T-cross-section (in use) with a web 12 extending between a lower flange 13 and an upper reinforcing bulb 14. The connector 11 is formed from web material and a trailing part of the connector 11 is disposed between the flange 13 and bulb 14. Typically, as is conventional, the web 12 and connector 11 are a double layer of the sheet steel forming the runner 10. For simplicity and visual clarity, these elements are shown as a single layer in the drawings.

The connector 11 includes a rectangular body 16 having a generally planar shape in a plane parallel to its web 12 and offset to the left when in plan view a distance about equal to the thickness of the web. An inward edge 17, of the body 16, as discussed below, is part of the connecting function of the connector 11. At an opposite end the body 16 has a tab 15 bent to the right when viewed in plan.

Two parallel stamped stiffening ribs 18 extend across most of the length of the rectangular body 16, projecting to the left when viewed in plan. At forward ends the ribs 18 terminate at lanced projections or lock lances 19 extending from the side of the body 16 opposite the ribs. Edges 21 of the lances 19 lie in a common vertical plane and as discussed below serve in the connecting function. Between the ribs 18 is stamped a lanced catch or lock lance 26, with an edge 30 at a plane at the nominal end of a main tee 10 and at a side opposite the stiffening ribs 18, to serve the connecting function described below. Adjacent and trailing the catch 26 is an opening 25.

The connector 11 has a spring tab 27 stamped from the tee web 12 forming the edge 17 of the body 16 and a pocket 28. The spring tab 27 has a distal end 29 flared away from the plane of the web 12.

Figure 4:
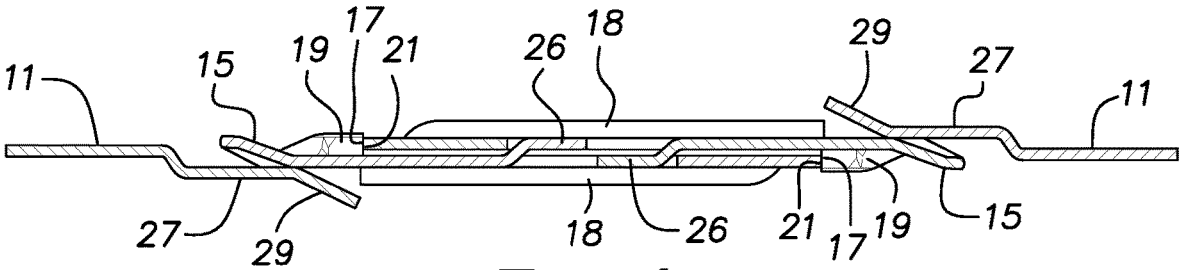
FIG. 4 is a longitudinal cross-section of the inventive connectors in coupled relation taken in the plane 4-4 in FIG. 2.

The connector 11 couples with another connector to join the ends of two main tees 10 as shown in FIGS. 2 and 4. More specifically, the tab 15 of each connector 11 is smoothly guided by the flared end 29 of the opposed connector so that the connector lead end moves into the opposed pocket 28. At the end of longitudinal motion the edges 19 of the lanced projections or catches 19 engage the edge 17 of the opposed connector 11 and trailing edge 30 of the lanced catch 26 engages the corresponding edge of the lanced catch 26 of the opposed connector through the opening 25. The spring tab 27 serves to resiliently hold the lead end of the opposed connector in contact with the connector associated with the spring tab (FIG. 4).

Engagement of the edges of the lanced projections 19 with the opposed edges 17 and between the edges of the projections 26 prevent separation of the connectors 11 under tensile forces. It will be noted that each of the projections 19, 26 will engage an opposing edge with at least two contact points or locking zones resisting tensile forces.

As used herein, the terms lance, lock lance or locking lance is a sheet-like formation that projects from one side of a sheet body and has a free locking edge severed, sheared or otherwise cut, that extends from the body at both ends of the edge and lies generally in a single plane generally perpendicular to the body.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A main tee for a suspended ceiling grid system comprising:

an inverted T-shaped runner having a central web extending between a lower flange and an upper reinforcing bulb; and first and second integral main tee connectors extending from opposed ends of the central web, each connector having a rectangular main body configured to couple with an identical opposed connector of an adjacent runner, each connector being stamped from metal strip material aligned strip-wise with the central web such that the runner and the first and second connectors are a unitary structure of one-piece construction, each connector having at least five locking projections positioned along the body resisting tensile forces distributed over an expanse thereof, and each connector having a spring tab located at an edge of the body, the spring tab including a pocket having a flared portion extending therefrom, the spring tab configured to hold the opposed connector in direct contact with a respective said integral main tee connector.

2. The main tee as set forth in claim 1, wherein said locking projections are lances from the strip material.

3. The main tee as set forth in claim 2, wherein the locking lances each form a locking edge that extends laterally away from a plane of the main body of the connector.

4. The main tee as set forth in claim 2, when coupled to said identical connector has the locking edge of each lance engaged with an edge surface of the identical connector at two or more points.

5. The main tee as set forth in claim 2, including stiffening beads stamped in each connector that assist in maintaining said lances engaged with edges of the opposed connector.

* * * * *